US009899750B1

(12) United States Patent
Doiron et al.

(10) Patent No.: US 9,899,750 B1
(45) Date of Patent: Feb. 20, 2018

(54) MODULAR CRIMP CONTACT

(71) Applicant: Teledyne Varisystems, Inc., Thousand Oaks, CA (US)

(72) Inventors: Roger Doiron, Airdrie (CA); Ilya Skorobogatov, Calgary (CA)

(73) Assignee: Teledyne Varisystems, Inc., Thousand Oaks, CA (US)

( * ) Notice: Subject to any disclaimer, the term of this patent is extended or adjusted under 35 U.S.C. 154(b) by 0 days.

(21) Appl. No.: 15/383,443

(22) Filed: Dec. 19, 2016

(51) Int. Cl.

| | |
|---|---|
| ***H01R 4/20*** | (2006.01) |
| ***H01R 4/18*** | (2006.01) |
| ***H01R 43/048*** | (2006.01) |
| ***H01R 43/24*** | (2006.01) |
| ***H01R 13/05*** | (2006.01) |
| ***H01R 13/11*** | (2006.01) |

(52) U.S. Cl.
CPC ..... *H01R 4/20* (2013.01); *H01R 4/183* (2013.01); *H01R 13/052* (2013.01); *H01R 13/111* (2013.01); *H01R 43/048* (2013.01); *H01R 43/24* (2013.01)

(58) Field of Classification Search
CPC ..... H01R 4/00; H01R 4/023
USPC ..... 439/879, 891
See application file for complete search history.

(56) References Cited

U.S. PATENT DOCUMENTS 2,816,341 A * 12/1957 Prest ..... F16B 21/07 24/590.1
3,101,983 A * 8/1963 Van Horssen ..... H01R 13/42 439/587
4,221,446 A * 9/1980 Niles ..... H01R 13/33 439/291
4,405,195 A * 9/1983 Cherry ..... H01R 13/193 439/825
4,964,807 A * 10/1990 Draus ..... H01R 11/24 439/169
5,358,433 A * 10/1994 Dechanteloup ..... H01R 13/111 439/843
5,439,391 A * 8/1995 McEtchin ..... H01R 31/06 439/518

* cited by examiner

*Primary Examiner* — Phuong Dinh
(74) *Attorney, Agent, or Firm* — Duncan Galloway Egan Greenwald, PLLC; Kevin T. Duncan

(57) ABSTRACT

The present invention relates to a modular crimp contact system and method. The modular crimp contact system comprises a crimping member secured to a conductor by having one end of the crimping member crimped about the exterior of the conductor. A locking ring disposed about the body of the crimping member locks the crimping member in a receiving end of a connection member. The connection member may have a pin or a socket on a connection end opposite the receiving end the connection member.

20 Claims, 6 Drawing Sheets

MODULAR CRIMP CONTACT

FIELD OF INVENTION

The present invention is related generally to a custom crimp contact system and method. More particularly, the present invention relates to a crimp contact system, which is adapted to be used with circular, non-circular commercial grade connectors and cable splices for use in subsea or terrestrial applications. The present invention provides a new system and method for attaching typical electrical contact by replacing it with a custom crimp contact.

BACKGROUND OF THE INVENTION

There are many known methods for attaching a connector to the end of a conductor or wire for use as an electrical connection. These systems typically involve soldering or crimping to secure the electrical contact to the conductor. These processes or assemblies can be difficult to complete or assemble when installing on multi-contact connectors and may be susceptible to human error and/or material failure.

The known systems and methods for securing a connector to a conductor can be time consuming and expensive. Additionally, other methods that do not use soldering or crimping may not be suitable for high stress or high differential pressure applications such as those typically found in oil and gas extraction and mining systems.

Furthermore, other systems for securing a conductor to a connector that do not require soldering may not be suitably modular or repairable. For example, for known systems if the connection on the end of a conductor becomes damaged, the entire connector may have to be removed and an entirely new connection may need to be installed.

Thus, what is needed is a modular connection system that does not require soldering, potting, or lengthy setting and curing times that can be attached to a conductor quickly and easily.

SUMMARY OF THE INVENTION

The present invention provides a modular system and method for an electrical contact. The electrical contact comprises a connection member, a crimping member, a locking ring and a conductor. The present invention provides a faster and easier method for securing an electrical contact to the end of a conductor.

Known methods for soldering a typical circular, commercial grade connector are time-consuming and inefficient. Known methods may include a typical circular, commercial grade connector having three separate components: a connector body, a collar and an endbell. The current methods of soldering a connection to conductors in a cable are inefficient and negatively affect productivity due to inconsistencies which can arise from manual labor through human error and through the long process of soldering of each contact in multi-conductor assemblies. The present invention provides a more standardized process which is more consistent and reliable than the methods of the prior art.

The present invention strives to increase efficiency and productivity by utilizing a modular crimp contact system. The modular crimp contact system of the present invention replaces the time-consuming soldering process, with a standardized, repeatable and reliable process. The modular crimp contact system of the present invention effectively removes as many as five steps from the known soldering connection processes by crimping a crimping member onto a conductor and securing the crimping member in a connection member with a locking ring. Additionally, the present invention may further comprise a flame rated thermoplastic polyurethane that chemically bonds with the molding materials.

Since the endbell used by the prior art methods is not used, the present invention removes the coating process previously necessary to bond the overmold to the endbell. Furthermore, the pre-potting process previously required to reduce injection machine blowout is not necessary. Additionally, with the modular crimp contact system of the present invention, there will be a complete elimination of blow out caused by injection or compression molding and pushing out of the inserts in the connectors, since the crimping member is crimped onto the conductor instead. The present invention solves multiple issues with the current process by removing unnecessary, complicated, and time consuming steps.

In one embodiment the present invention provides a modular crimp contact system comprising: a conductor; a crimping member comprising a contact end and a crimping body end, the contact end having a larger diameter than the crimping body end, the crimping body end having a crimping body cavity adapted to receive the conductor, wherein the conductor is secured within the crimping body cavity by being crimped by the crimping body end of the crimping member; a locking ring disposed about the crimping body end of the crimping member; and a connection member having a connection end and a receiving end, the receiving end comprising a receiving end cavity adapted to be disposed about the contact end of the crimping member, the receiving end cavity further comprising a locking ring recess adapted to secure the locking ring.

The embodiment may further comprise wherein the locking ring comprises a locking ring body with a first end and a second end, the locking ring body being substantially circular and being tapered inward from the first end to the second end, wherein the first end abuts the contact end of the crimping member. The locking ring body may comprise a locking ring gap. The locking ring may be adapted to contract to fit within the receiving end cavity of the connection member and may further be adapted to expand to seat within the locking ring recess of the receiving end cavity. The locking ring, when seated in the locking ring recess, may secure the contact end of the crimping member within the receiving end cavity. The connection end of the connection member may comprise a pin. The connection end of the connection member may comprise a socket. The connection member may comprise a set of ridges. The set of ridges may be adapted to secure insulation about the connection member. The set of ridges may be adapted to secure the connection member in an injection or compression injection or compression molded socket. The contact end of the crimping member may comprise a tapered end adapted to pass through the locking ring.

In a second embodiment the present invention provides method for securing a connection member to a conductor, the method comprising: inserting an end of a conductor into a crimping body end of a crimping member, the crimping member further comprising a contact end; crimping the crimping body end of the crimping member to secure the end of the conductor within the crimping body end; placing a locking ring about the crimping body end of crimping member; inserting the crimping member into a receiving end of the connection member; and seating the locking ring in a locking ring recess in the receiving end of the connection member.

The method of the above embodiment may further comprise wherein the locking ring comprises a locking ring body with a first end and a second end, the locking ring body being substantially circular and being tapered inward from the first end to the second end, wherein the first end abuts the contact end of the crimping member. The locking ring body may comprise a locking ring gap. The receiving end may further comprise a receiving end cavity and the locking ring recess may be disposed within the receiving end cavity and the locking ring may be adapted to contract to fit within the receiving end cavity of the connection member and may be further adapted to expand to seat within the locking ring recess of the receiving end cavity. The locking ring, when seated in the locking ring recess, may secure the contact end of the crimping member within the receiving end. The connection member may further comprise a connection end. The connection end of the connection member may comprise one of a pin or a socket. The connection member may further comprise a set of ridges. The method may further comprise securing an insulation layer about the set of ridges of the connection member and the conductor. The method may further comprise injection molding the connection member into an injection molded socket or compression injection or compression molding. The contact end of the crimping member may comprise a tapered end adapted to pass through the locking ring.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

Figure 1:
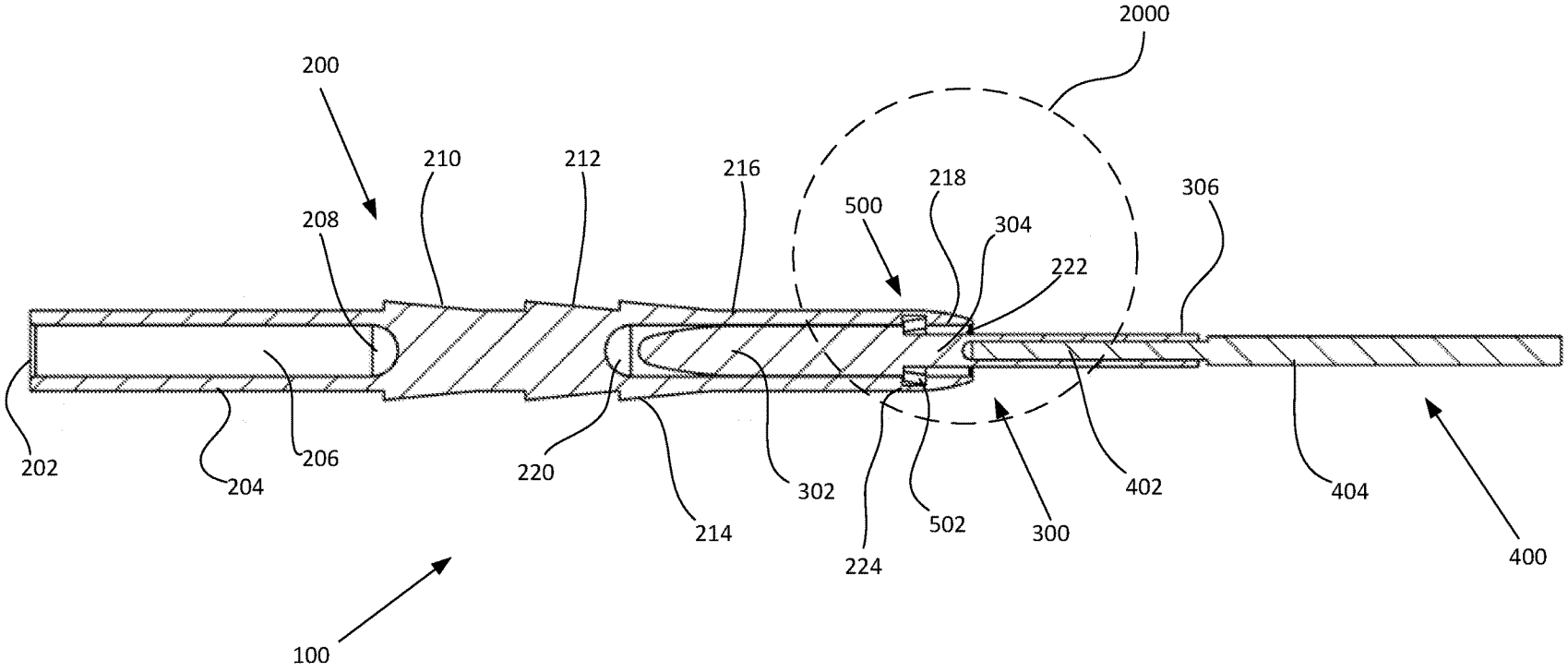
FIG. 1 provides a cross section view of a modular crimp contact system according to the present invention.
Figure 5:
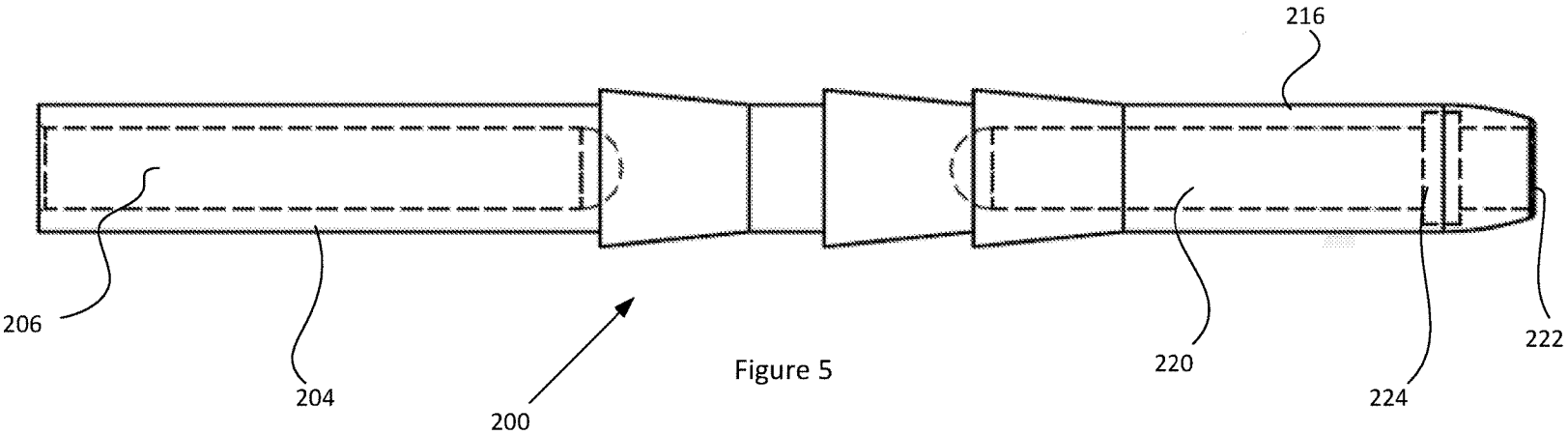
FIG. 5 provides a side view of a connection member according to the present invention.
Figure 6:
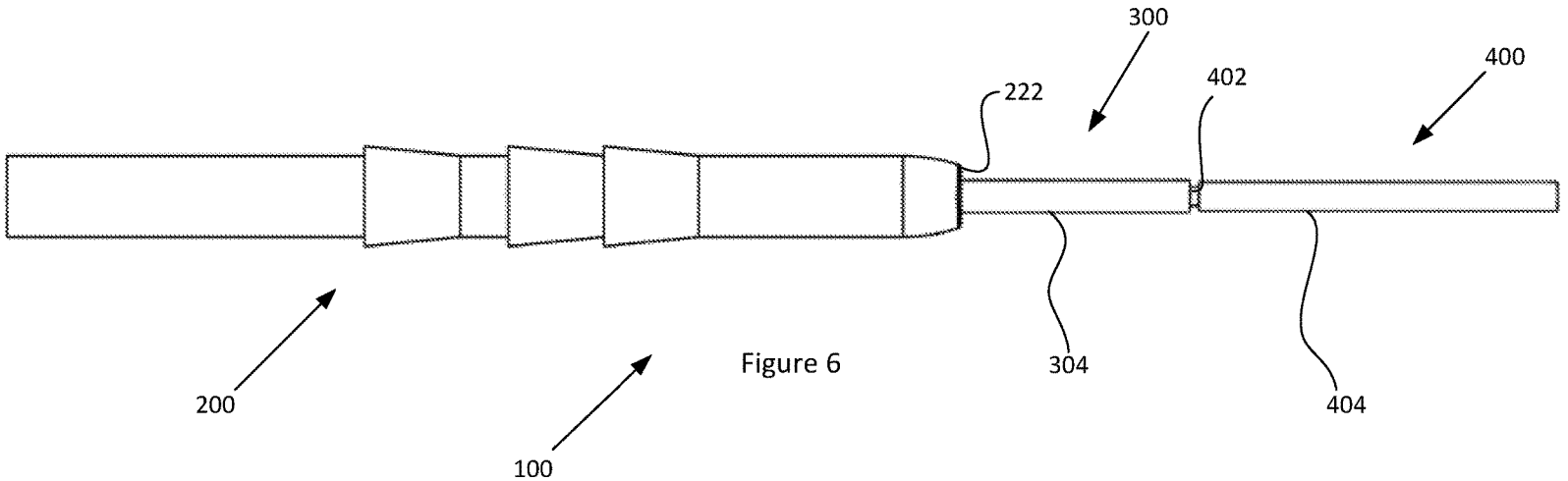
FIG. 6 provides a side view of a crimping member and conductor mated with a connection member according to the present invention.
Figure 8:
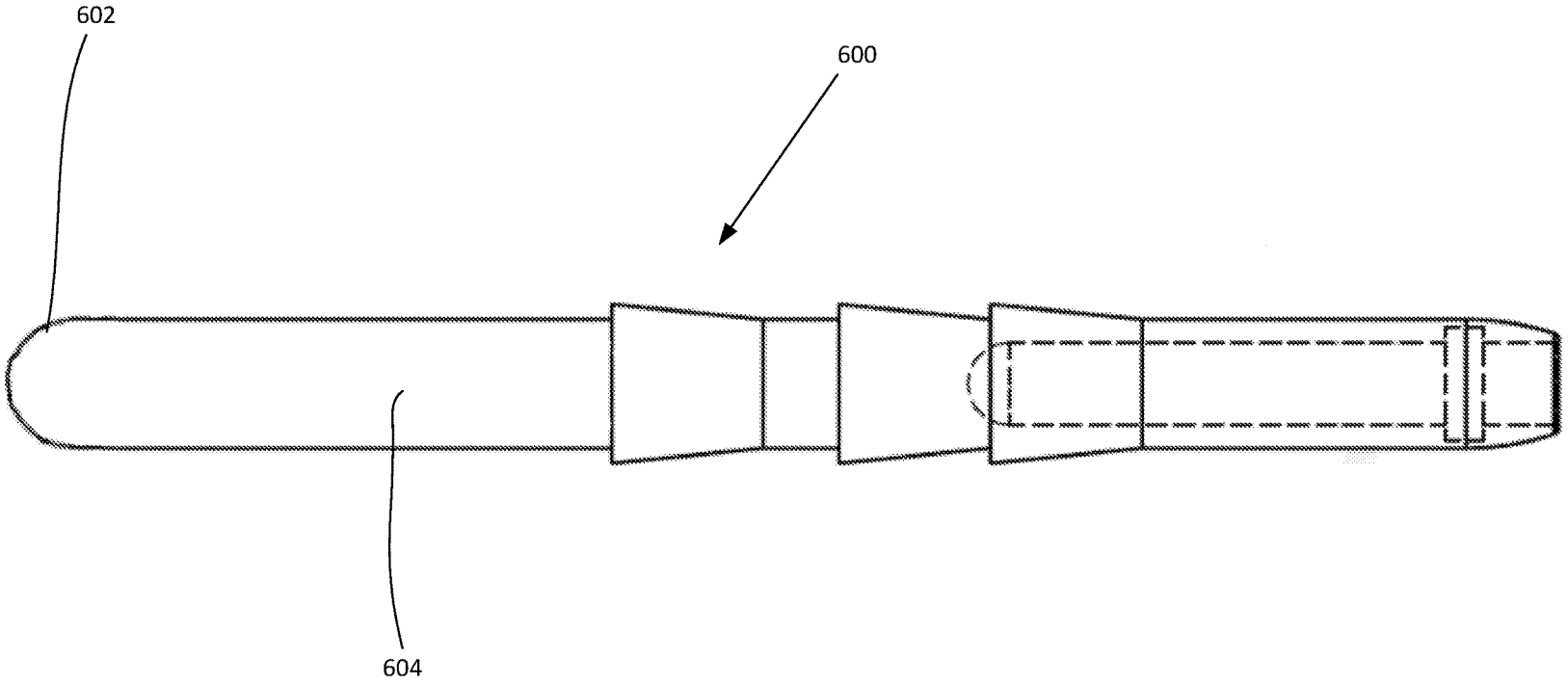
FIG. 8 provides a side view of a connection pin member according to the present invention.

With reference to FIG. 1, a lateral cross-section view of a modular crimp contact system 100 according to the present invention is provided. The modular crimp contact system 100 comprises a connection socket member 200, a crimping member 300, a conductor 400, and a locking ring 500. The connection socket member 200 may be a socket, as shown in FIGS. 1, 5 and 6, or may be a connection pin member 600 as shown in FIG. 8. The connection socket member 200 comprises a connection end 204 having a connection end opening 202 and a connection end cavity 206 that terminates at connection end termination 208. A series of ridges, first ridge 210, second ridge 212, and third ridge 214, are disposed between the connection end 204 and the receiving end 216 of the connection socket member 200. The receiving end 216 of the connection socket member 200 has a receiving end taper 218 that tapers towards the receiving end opening 222 of the receiving end cavity 220. The crimping member 300 comprises a contact end 302, a crimping member body 304, and a crimping body end 306. The locking ring 500 is disposed around the crimping member body 304 of the crimping member 300 and secures the crimping member 300 within the receiving end cavity 220 of the connection socket member 200. The conductor 400 comprises a conductor end 402 and a conductor length 404. The conductor length 404 may be any required length, and the conductor end 402 is the termination of the conductor 404. The conductor end 402 is adapted to be disposed within the crimping body end 306 of the crimping member 300.

The embodiment of the modular crimp contact system 100 provided in FIG. 1 may be assembled by first taking the conductor 400 and removing any insulation or other non-electrically conductive coating that may be present on the conductor end 402. The conductor 400 may be comprised of any suitable electrically conductive material such as copper. Before the conductor 400 is crimped to the crimping member 300, a locking ring 500 is placed about the crimping member body 304 of the crimping member 300. Alternatively, the locking ring 500 may first be placed within the locking ring recess 224 prior to mating the crimping member 300 with the connection socket member 200. The conductor end 402 of the conductor 400 is placed within the crimping body end 306 of the crimping member 300. A suitable crimping tool is then used to apply pressure to the exterior of the crimping body end 306 to securely affix or crimp the crimping body end 306 to the conductor end 402 of the conductor 400. The joined crimping member 300 and conductor 400 may then be inserted into and joined with the connection socket member 200 by placing the contact end 302 of the crimping member 300 fully into the receiving end cavity 220 of the connection socket member 200 through the receiving end opening 222 until the crimping member 300 is secured by the locking ring 500. The locking ring body 502 of the locking ring 500 will compress as it passes through the receiving end opening 222 of the receiving end cavity 220 until it expands to sit in the locking ring recess 224. In another embodiment, where the locking ring 500 is first seated in the locking ring recess 224, the locking ring body 502 of the locking ring 500 will expand or flex as the contact end 302 of the crimping member passes through it. In either embodiment, the locking ring 500 will secure the crimping member 300 within the receiving end cavity 220. This will form an electrical connection between the conductor 400 and the connection socket member 200, allowing electrical current or signals to pass from the connection end 204 to the receiving end 216 through the crimping member 300 and then to the conductor 400 and vice versa.

The connection socket member 200 may be formed entirely of a conductive material or may comprise a non-conductive outer layer with a conductive core that may for all or part of the interior of the connection socket member 200 including the connection end cavity 206 and the receiving end cavity 220. The first ridge 210, second ridge 212, and third ridge 214 disposed at the middle of the connection socket member 200 may be used to secure the connection socket member 200 within an end bell or potting, or may be used to secure an injection molded covering or insulating layer about the connection socket member 200. The covering or insulating layer may also be compression injection or compression molded. For example, a heat-shrinkable thermoplastic sleeve may be secured about the connection socket member 200 and conductor 400 by placing it about the connection socket member 200 and conductor 400 and heating the sleeve until it forms a tight seal. In another example the first ridge 210, second ridge 212, and third ridge 214 may secure the connection member 200 within an injection molded socket. In other embodiments, the connection socket member 200 may not have the set of ridges including the first ridge 210, second ridge 212, and third ridge 214, or may have a differing number of ridges based on the application and requirements of the application. The conductor 400 may be a conductor of any suitable type including wires of varying American wire gauge (AWG) or other standard wire sizes. The conductor 400 may also have one or more insulating layers or jackets disposed about the conductor length 404 providing electrical and/or thermal insulation to the conductor 400.

The design of the modular crimp contact system 100 enables for easy and fast removal or replacement of the connection socket member 200. For example, if the connection socket member 200 becomes damaged or otherwise becomes non-functional, it may be removed from the crimping member 300 and replaced with a new connection member. Additionally, the connection socket member 200 may be replaced with a connection pin member 600 as shown in FIG. 8 if necessary for the application in which the modular crimp contact system 100 is used. Moreover, the design of the modular crimp contact system 100 enables for fast initial assembly of the system 100 without requiring time and labor intensive steps such as soldering, brazing, etc. To secure the connection socket member 200 to the conductor 400, an installer or assembler need only crimp the crimping member 300 to the conductor 400 and then seat the crimping member 300 within the connection socket member 200. Insulation, jacketing, or other covers such as an injection molded covering may then be installed about the modular crimp contact system 100, or the modular crimp contact system 100 may be installed as one of a set of contacts within a plug or cable termination. The area 2000 where the locking ring 500 secures the crimping member 300 within the connection socket member 200 is shown in greater detail in FIG. 2.

Figure 2:
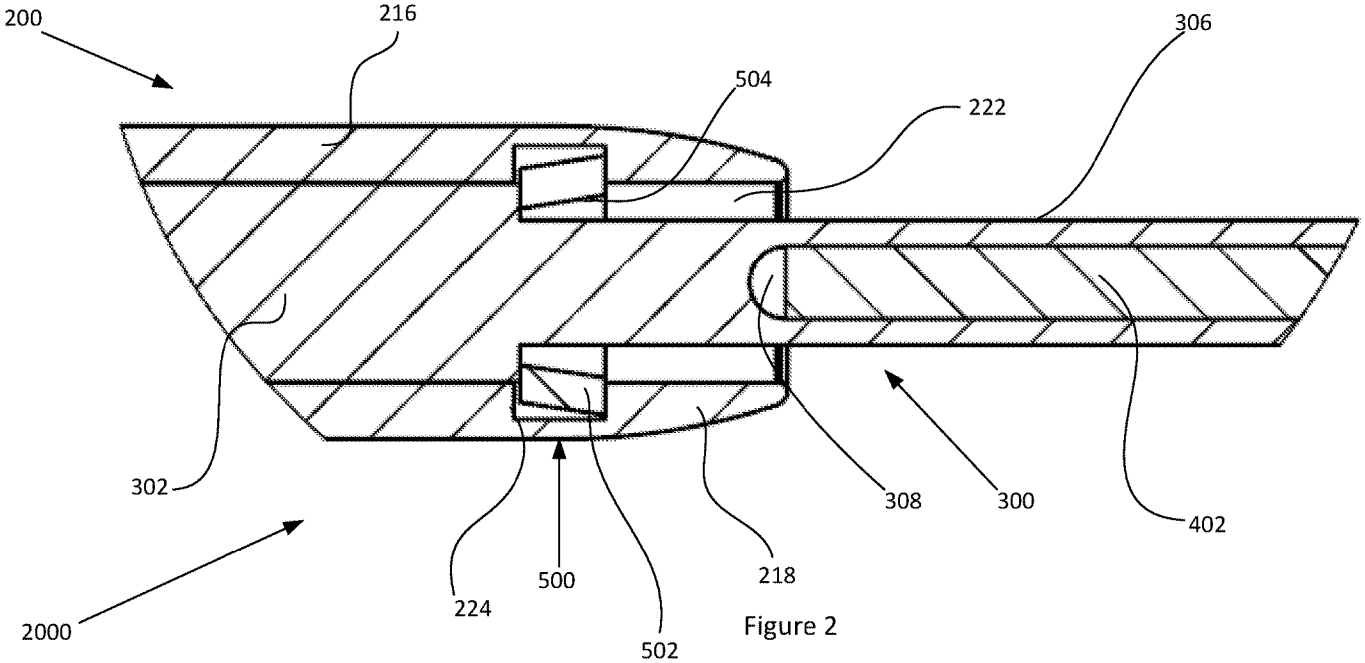
FIG. 2 provides a detailed cross section view of a locking ring, crimping member, and connection member according to the present invention.

With reference now to FIG. 2, a detailed cross-section area 2000 showing where the locking ring 500 secures the crimping member 300 within the connection socket member 200 is provided. The conductor end 402 is shown in the crimping body cavity 308 of the crimping body end 306 and has been secured within the crimping body cavity 306 by a crimping tool. The contact end 302 of the crimping member 300 is pushed through the receiving end opening 222. When the locking ring 500 reaches the locking ring recess 224 the locking ring body 502 expands to fit in the locking ring recess 224. The locking ring interior 504 will not expand beyond the exterior of the contact end 302. The expansion of the locking ring 500 secures the crimping member 300 within the receiving end cavity 220 of the receiving end 216 of the connection socket member 200. The securing of the crimping member 300 by the locking ring 500 provides for a releasable and non-permanent means of securing the crimping member 300 within the connection socket member 200.

Figure 3:
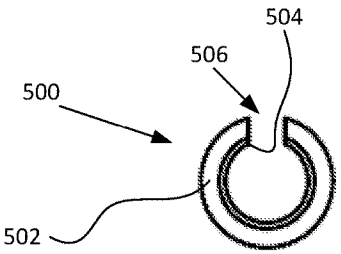
FIG. 3 provides a bottom plan view of a locking ring according to the present invention.
Figure 4:
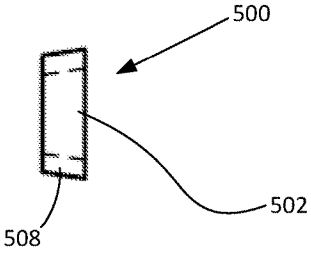
FIG. 4 provides a side view of a locking ring according to the present invention.

With reference now to FIGS. 3 and 4, a bottom plan view a side view respectively of the locking ring 500 are provided. The locking ring body 502 of the locking ring 500 is not a completely closed loop. The locking ring 500 has a locking ring gap 506 in the locking ring body 502 that enables the locking ring 500 to expand and contract to fit about the crimping member body 304 and within the locking ring recess 224 and receiving end cavity 220. The locking ring exterior 508 and locking ring interior 504 is tapered or angled such that the locking ring 500 may more easily pass through the receiving end opening 222 and into the locking ring recess 224. The interior taper of the locking ring interior 504 enables the contact end 302 of the crimping member 300 to more easily pass through the locking ring 500 and also enables a tool such as the locking ring tool 700 shown in FIGS. 9 and 10 to expand the locking ring 500 to remove then crimping member 300 from the connection socket member 200. The locking ring 500 may be comprised of any suitable deformable metal or plastic capable of expanding and contracting and securing the crimping member 300 within the connection socket member 200.

With reference now to FIG. 5, a lateral view and partial cross-section of the connection socket member 200 according to the present invention is provided. The lateral view of the connection socket member 200 shows the exterior of the connection end 204 and receiving end 216. The connection end 204 has a connection end cavity 206 adapted to receive a pin or other connector. The connection end cavity 206 may be any shape required to receive a pin or connector used a system. The receiving end 216 has a receiving end cavity 220 accessible through a receiving end opening 222 and that also comprises a locking ring recess 224. FIG. 6 provides a lateral view of a modular crimp contact system 100 having a conductor 400 disposed within a crimping member 300 and secured within a connection socket member 200. The crimping body end 306 may extend any desired length beyond the receiving end opening 222. The conductor end 402 may or may not be exposed, and the conductor length 404 may directly abut the end of the crimping body end 306.

Figure 7:
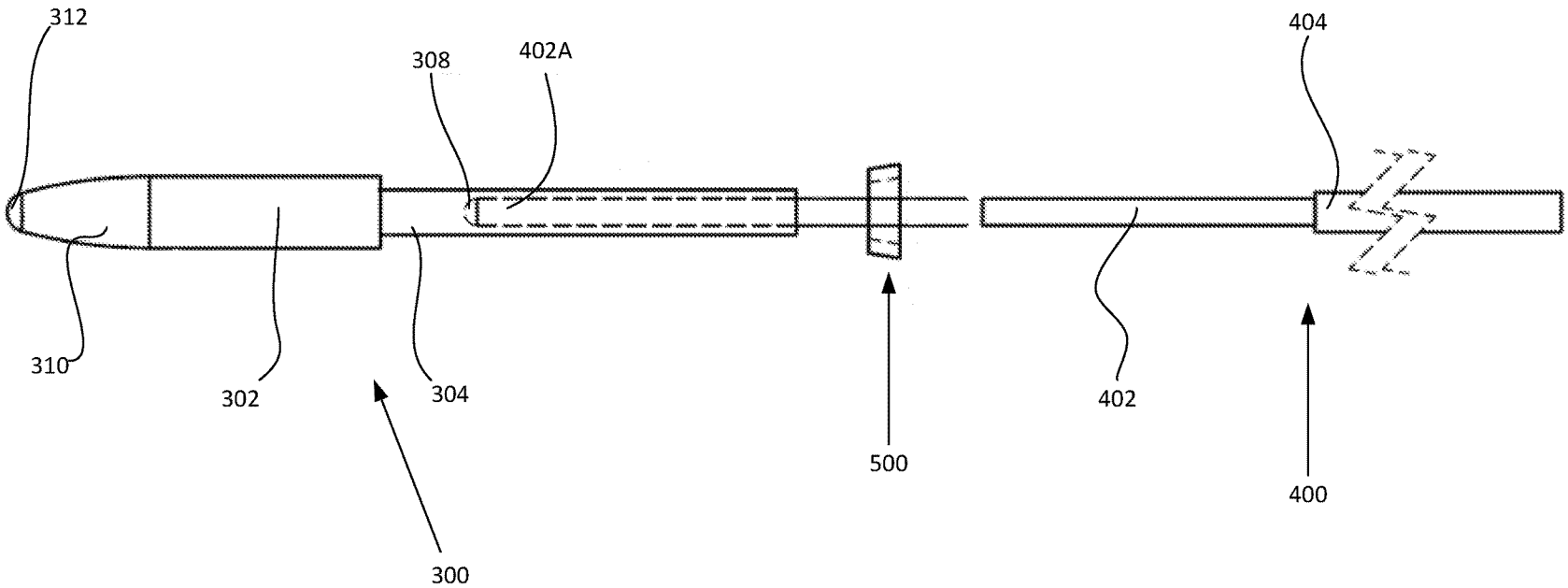
FIG. 7 provides a partial cross-section view of a crimping member, a locking ring, and conductor according to the present invention.

With reference now to FIG. 7, a partial cross-section view of a crimping member 300, a locking ring 500, and conductor 400 in a mated/crimped and an un-mated state are provided. The crimping member has a contact end 302 with a contact end taper 310 that tapers to a contact end termination 312. The taper of the contact end taper 310 enables the contact end 302 to more easily be inserted into a connection socket member 200. The conductor end 402 and conductor length 404 is shown unmated with the crimping member 300. The conductor end (mated) 402A is disposed within the crimping body cavity 308 of the crimping end 306 with the locking ring 500 disposed around the exterior of the conductor end (mated) 402A. When inside the crimping body cavity 308 the crimping member end 306 would be compressed or crimped about the conductor end (mated) 402A to secure the conductor end (mated) 402A within the crimping body cavity 308. In this configuration, the locking ring 500 would be seated within the locking ring recess 224 of the connection socket member 200 by a locking ring tool 700 as shown in FIGS. 9 and 10.

With reference now to FIG. 8, a side view of a connection pin member 600 is provided. The connection pin member 600 is similar to the connection socket member 200 but the connection pin member 600 comprises a connection pin body 604 having a connection pin termination 602 and does not comprise a connection end opening or cavity.

Figure 10:
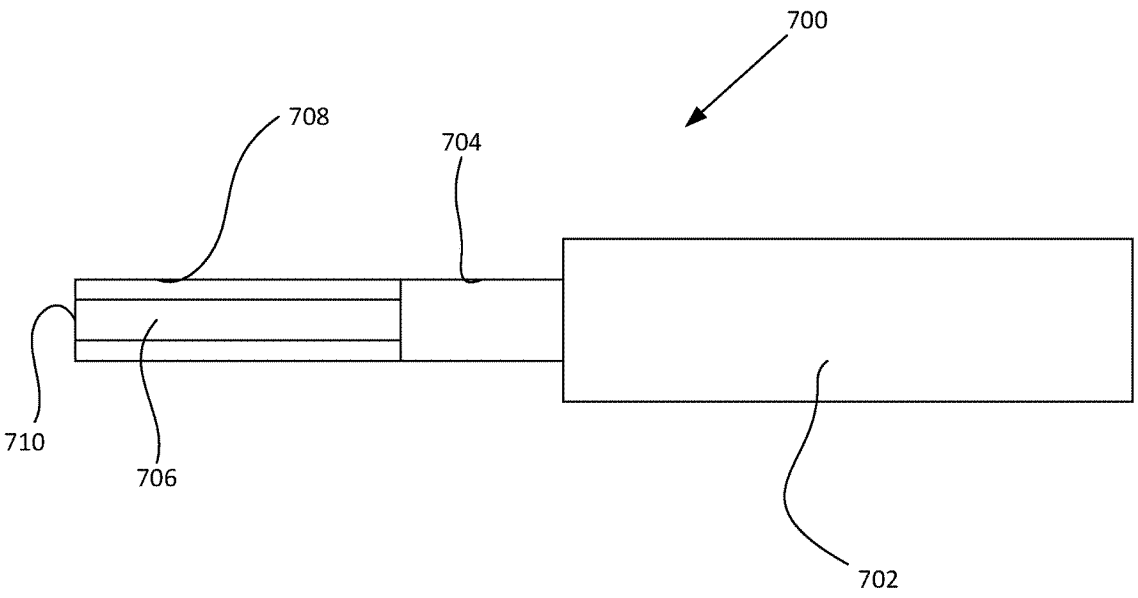
FIG. 10 provides a side view of a locking ring tool according to the present invention.
Figure 9:
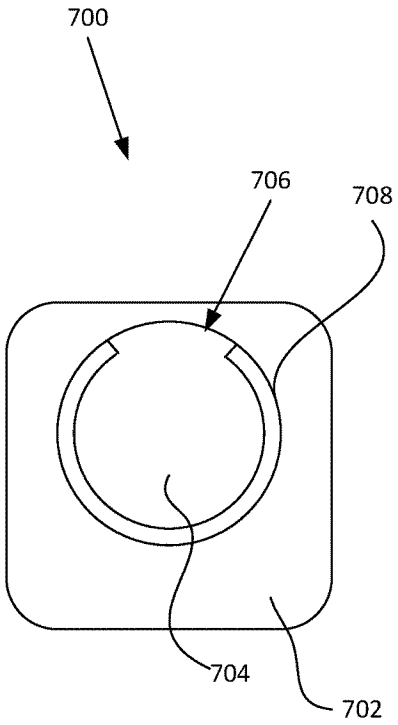
FIG. 9 provides a front view of a locking ring tool according to the present invention.

With reference now to FIGS. 9 and 10, front and side views respectively of a locking ring tool 700 are provided. The locking ring tool 700 comprises a tool handle 702, tool body 704, tool end 708, tool end opening 706, and tool end termination 710. The locking ring tool 700 is operated by a user holding the tool handle 702. The tool end opening 706 would be placed over the crimping member body 304 and the tool end termination 710 would be placed behind the locking ring 500. The tool end 708 would then be used to slide the locking ring 500 forward into a seated position in the locking ring recess 224 of the connection member 200. The tool end 708 may also be slid within the locking ring interior 504 to expand the locking ring 500 to enable the crimping member 300 to be removed from the connection member 200.

While the invention has been described by reference to certain preferred embodiments, it should be understood that numerous changes could be made within the spirit and scope of the inventive concept described. In implementation, the inventive concepts may be automatically or semi-automatically, i.e., with some degree of human intervention, performed. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. A modular crimp contact system comprising:

a conductor;

a crimping member comprising a contact end and a crimping body end, the contact end having a larger diameter than the crimping body end, the crimping body end having a crimping body cavity adapted to receive the conductor, wherein the conductor is secured within the crimping body cavity by being crimped by the crimping body end of the crimping member;

a locking ring disposed about the crimping body end of the crimping member;

a connection member having a connection end and a receiving end, the receiving end comprising a receiving end cavity adapted to be disposed about the contact end of the crimping member, the receiving end cavity further comprising a locking ring recess adapted to secure the locking ring; and wherein the locking ring is adapted to be forcibly expanded to permit the crimping member to pass through the locking ring.

2. The modular crimp contact system of claim 1 wherein the locking ring comprises a locking ring body with a first end and a second end, the locking ring body being substantially circular and being tapered inward from the first end to the second end, wherein the first end abuts the contact end of the crimping member.

3. The modular crimp contact system of claim 2 wherein the locking ring body comprises a locking ring gap.

4. The modular crimp contact system of claim 3 wherein the locking ring is adapted to contract to fit within the receiving end cavity of the connection member and further adapted to expand to seat within the locking ring recess of the receiving end cavity.

5. The modular crimp contact system of claim 1 wherein the locking ring, when seated in the locking ring recess, secures the contact end of the crimping member within the receiving end cavity.

6. The modular crimp contact system of claim 1 wherein the connection end of the connection member comprises one of a pin or a socket.

7. The modular crimp contact system of claim 1 wherein the connection member further comprises a set of ridges.

8. The modular crimp contact system of claim 7 wherein the set of ridges are adapted to secure insulation about the connection member.

9. The modular crimp contact system of claim 7 wherein the set of ridges are adapted to secure the connection member in an injection molded socket.

10. The modular crimp contact system of claim 1 wherein the contact end of the crimping member comprises a tapered end adapted to pass through the locking ring.

11. A method for securing a connection member to a conductor, the method comprising:

inserting an end of the conductor into a crimping body end of a crimping member, the crimping member further comprising a contact end;

crimping the crimping body end of the crimping member to secure the end of the conductor within the crimping body end;

placing a locking ring about the crimping body end of the crimping member, the locking ring adapted to be forcibly expanded to permit the crimping member to pass through the locking ring;

inserting the crimping member into a receiving end of the connection member; and seating the locking ring in a locking ring recess in the receiving end of the connection member.

12. The method of claim 11 wherein the locking ring comprises a locking ring body with a first end and a second end, the locking ring body being substantially circular and being tapered inward from the first end to the second end, wherein the first end abuts the contact end of the crimping member.

13. The method of claim 12 wherein the locking ring body comprises a locking ring gap.

14. The method of claim 13 wherein the receiving end further comprises a receiving end cavity and the locking ring recess is disposed within the receiving end cavity; and wherein the locking ring is adapted to contract to fit within the receiving end cavity of the connection member and further adapted to expand to seat within the locking ring recess of the receiving end cavity.

15. The method of claim 11 wherein the locking ring, when seated in the locking ring recess, secures the contact end of the crimping member within the receiving end.

16. The method of claim 11 wherein the connection member further comprises a connection end, the connection end comprising one of a pin or a socket.

17. The method of claim 11 wherein the connection member further comprises a set of ridges.

18. The method of claim 17 further comprising securing an insulation layer about the set of ridges of the connection member and the conductor.

19. The method of claim 17 further comprising injection molding the connection member into an injection molded socket.

20. The method of claim 11 wherein the contact end of the crimping member comprises a tapered end adapted to pass through the locking ring.

* * * * *